United States Patent [19]

Ten Broeck et al.

[11] 4,162,766

[45] Jul. 31, 1979

[54] VEHICULAR SPREADER FOR ICY ROADS AND THE LIKE

[76] Inventors: Dale K. Ten Broeck, 1168 Douglas La., Redding, Calif. 96001; Stanley N. Cuson, 35757 Ballantine Pl., Fremont, Calif. 94536; Hal K. Sorenson, 4560 Lawrence Dr., Roseville, Calif. 95678

[21] Appl. No.: 833,886

[22] Filed: Sep. 16, 1977

[51] Int. Cl.[2] ..... E01H 5/00; B01F 15/02

[52] U.S. Cl. ..... 239/656; 222/135; 222/545; 239/657; 239/675; 291/1; 291/33; 298/8 R

[58] Field of Search ..... 291/1, 33; 298/8 R; 222/135, 138, 545, 610, 626, 627; 239/656, 657, 663, 672, 675, 676

[56] References Cited

U.S. PATENT DOCUMENTS

| | | | |
|---|---|---|---|
| 1,566,540 | 12/1925 | Ketcham | 298/8 R |
| 2,967,056 | 1/1961 | D'Amato | 239/676 X |
| 3,429,418 | 2/1969 | Fyrk | 239/656 |

FOREIGN PATENT DOCUMENTS

| | | | |
|---|---|---|---|
| 1122075 | 7/1968 | United Kingdom | 239/675 |

*Primary Examiner*—James B. Marbert
*Assistant Examiner*—Andres Kashnikow

[57] ABSTRACT

An auxiliary hopper is attached to the rear of a cinder spreading truck. The auxiliary hopper carries salt. The cinders and salt are discharged from their respective storage hoppers in predetermined proportions, are mixed and dumped onto a spreader for application to the roadway. A hydraulic control mechanism allows continuous variation of the proportions of salt and cinders in the mixture applied to the roadway.

6 Claims, 10 Drawing Figures

VEHICULAR SPREADER FOR ICY ROADS AND THE LIKE

This invention relates to vehicles used to apply materials to icy and snow-covered roadways. In particular, the invention is a mechanism which may be applied to most vehicles currently in use throughout the United States with very little modification to the existing chassis and body of the truck.

Prior to the instant invention, vehicles applying cinders and salt to a roadway have carried a predetermined mixture of cinders and salt in a single storage hopper or bed. As the operator drives down the highway, he can control the amount of the mixture applied to the roadway but he cannot vary the proportions of salt and cinders applied to the roadway after the hopper or bed of the truck has been loaded. In many instances, it is desirable to apply only cinders to a section of the roadway. In other instances, it is desirable to apply a much higher proportion of salt to a section of the roadway than is carried in the hopper or bed of the truck. The ecological impact of applying undesirable amounts of chemicals to icy and snow-covered roadways makes it extremely desirable for operators of such vehicles to be able to continuously vary the proportions of salt and cinders applied to such roadways.

The present invention allows the operator of such vehicles to continuously vary the proportions of salt and cinders applied to the roadway. It is understood that materials other than salt and cinders may be loaded into the truck, but for purposes of explanation, we describe the invention with respect to the use of salt and cinders.

An auxiliary hopper is attached to the rear of a cinder-spreading truck. The auxiliary hopper is loaded with salt and the discharge of the auxiliary hopper empties into a mixing region in which the salt is mixed with the cinders in predetermined proportions. The mixture is then dropped onto a spreader and applied to the roadway.

The prior art includes spreader trucks which carry a single storage area which discharges its load onto a spinning spreader at a rate controlled by the operator and is applied to the roadway by the spreader. The prior art also includes Sipusic U.S. Pat. No. 3,239,106 which discloses a hand cart for dispensing proportions of tar and gravel on roof tops through the use of rather crude, hand-operated valves. The purpose of the valves in Sipusic is to adjust for varying pitches of roof tops. There is no teaching in Sipusic of continuously varying the proportions of the mixture dispensed from the apparatus. Similarly, Sipusic contains no suggestion of continuously applying various proportions of materials to icy or snow-covered roadways.

A primary object of the present invention is to provide an improved system for applying materials to icy or snow-covered roadways in which the operator may continuously vary the proportions of materials being applied to the roadway.

A further object of the invention is to provide a system which may be added onto existing trucks with very little modification to the chassis or body of the truck.

Other objects and advantages of the instant invention will become apparent from the following disclosure of the preferred embodiment and the drawings wherein.

Figure 1:
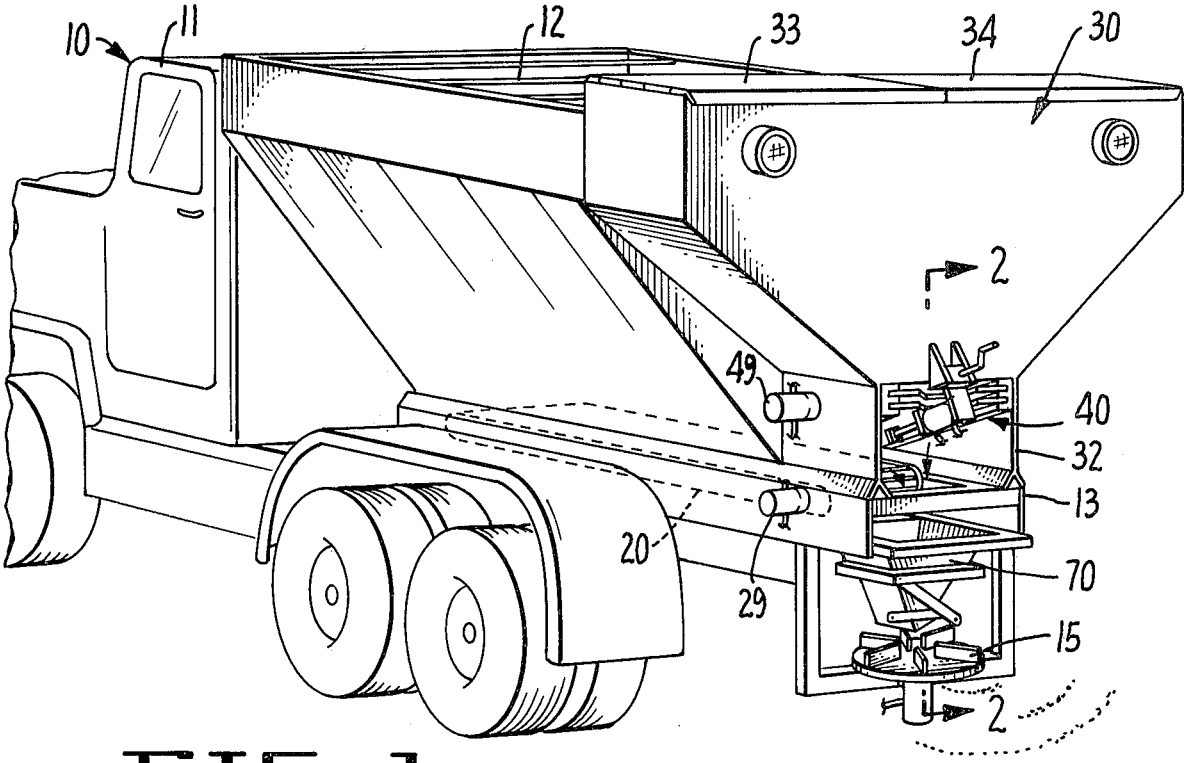
FIG. 1 is a perspective view of a hopper body truck incorporating the invention.
Figure 2:
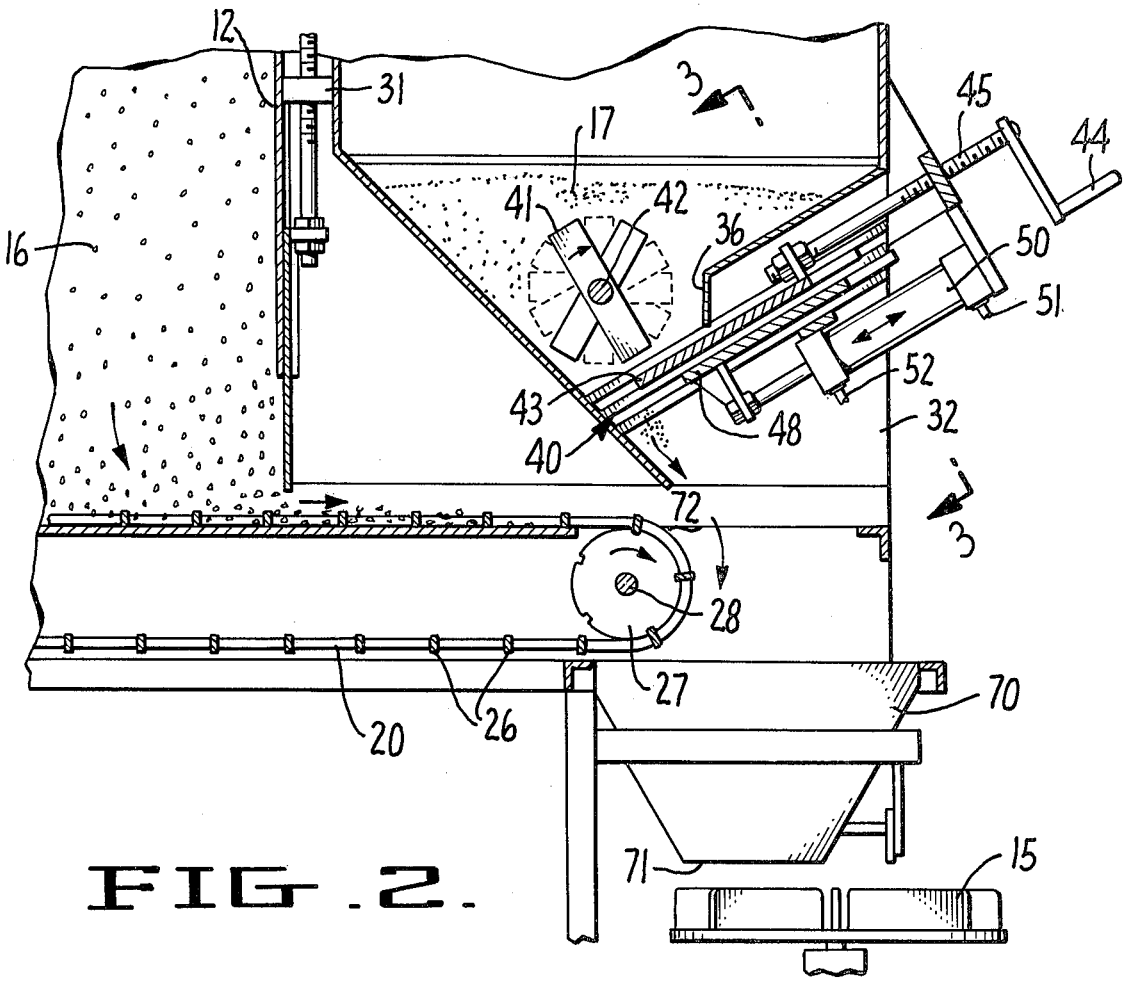
FIG. 2 is a sectional view along the line 2—2 of FIG. 1.

Referring to the drawings, FIG. 1 shows a conventional hopper body truck 10 having a cab 11, a hopper or storage tank 12 and a spreader 15. A discharge conveyor 20 is shown partially in phantom in FIG. 1 and is shown best in FIG. 2. Discharge conveyor 20 is driven by hydraulic motor 29 which drives a shaft 28 carried by chassis 13 and a sprocket 27 which interlocks with lugs 26 on discharge conveyor 20. The hopper body truck 10, discharge conveyor 20 and spreader 15 represent the basic components of the prior art hopper body spreader trucks. As shown in FIG. 2, a first material 16 such as cinders is carried in storage tank or hopper 12. Discharge conveyor 20 carries cinders 16 in the direction of the arrows to the spreader 15 for application to the roadway.

In accordance with the present invention, auxiliary storage means 30 is a hopper mounted on the rear of storage tank 12. Auxiliary hopper 30 carries a second material 17 such as salt.

Auxiliary hopper 30 may be attached at point 31 by welding to the rear of storage tank 12. The bottom portion 32 of auxiliary hopper 30 is carried by the rearmost portion of the chassis 13 of truck 10. Weather-tight foldable tops 33 and 34 protect the contents of auxiliary hopper 30 from the weather.

Figure 3:
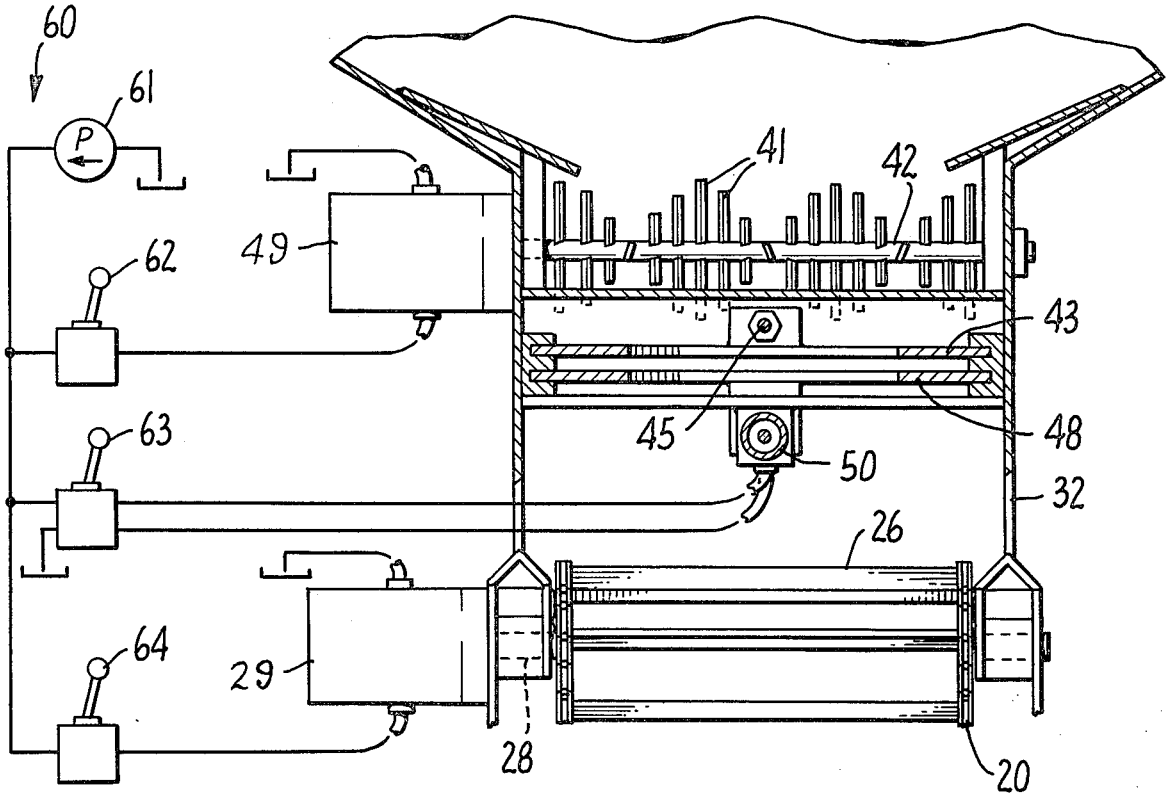
FIG. 3 is a sectional view along the line 3—3 of FIG. 2 with features of the invention shown schematically.

Discharge means 40 of auxiliary hopper 30 is positioned at the lowermost portion of auxiliary hopper 30. Discharge means 40 shown in FIGS. 1 through 3 is primarily a gravity feed discharge system, assisted by chunk breaker 41 which extends transversely across the bottom portion of auxiliary hopper 30, rotating on shaft 42. Hydraulic motor 49 drives the chunk breaker 41. As shown best in FIG. 2, a first slidable plate 43 is driven by hand crank 44 which is threaded along its shaft 45. As the hand crank 44 is rotated, plate 43 moves across the bottom of auxiliary hopper 30 from a position in which plate 43 completely seals off the bottom of auxiliary hopper 30 to a position in which plate 43 is withdrawn beyond the rear wall 36 of auxiliary hopper 30.

A second slidable plate 48 also extends across the bottom of auxiliary hopper 30 and is driven by hydraulic drive means 50. Hydraulic drive means 50 is a hydraulic cylinder connected by lines 51 and 52 to a hydraulic control means 60 shown best in FIG. 3. Hydraulic control means 60 comprises a pump 61, cab-mounted control levers 62, 63 and 64 which control respectively a hydraulic motor 49 for chunk breaker 41, the hydraulic drive means 50 and hydraulic motor 29 which drives the discharge conveyor 20 of storage tank 12. The position of slidable plate 48 varies with the position of control lever 63 which is operated by the driver of the vehicle as the vehicle moves down the road. Slidable plate 48 may be positioned so as to completely close off the bottom of auxiliary hopper 30, may be withdrawn past the rear wall 36 of auxiliary hopper 30 or may be positioned at any intermediate location between these extremes selected by the operator. It is possible to use either slidable plate 43 or slidable plate 48 alone. However, it is advantageous to incorporate the hand driven plate 43 in the apparatus in the event of a failure of the hydraulic control system. It is apparent that if only slidable plate 43 were utilized, the operator would have to stop the truck and walk to the rear of the vehicle and turn hand crank 44 to vary the rate at which salt is discharged from auxiliary hopper 30. The use of the cab-operated hydraulic control means 60 and 50 allows the operator to continuously vary the proportions of salt and cinders as he drives down the highway.

A mixing means 70 is provided which in the embodiment shown in FIG. 2 is a chamber in which the exterior walls converge in the downward direction. At the lowermost edge 71 of mixing means 70, the salt and cinders are dumped onto spreader 15 and are applied to the roadway as spreader 15 spins. The mixing of the salt and cinders begins as the two materials converge at the point indicated as numeral 72 in FIG. 2. At this point, salt dropping downwardly from auxiliary hopper 30 converges with cinders passing along discharge conveyor 20 from storage tank 12.

Figure 4:
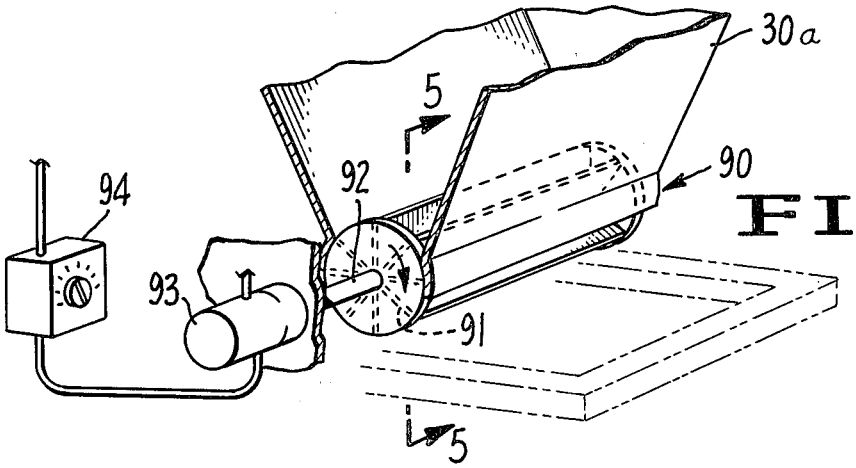
FIG. 4 is a perspective view of an alternate embodiment of a portion of the invention.
Figure 5:
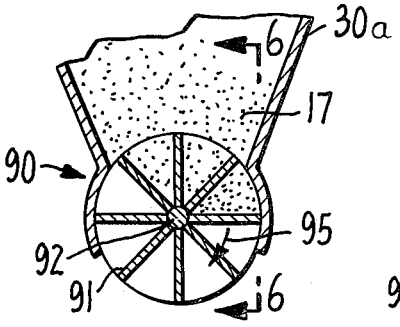
FIG. 5 is a sectional view along the line 5—5 of FIG. 4.
Figure 6:
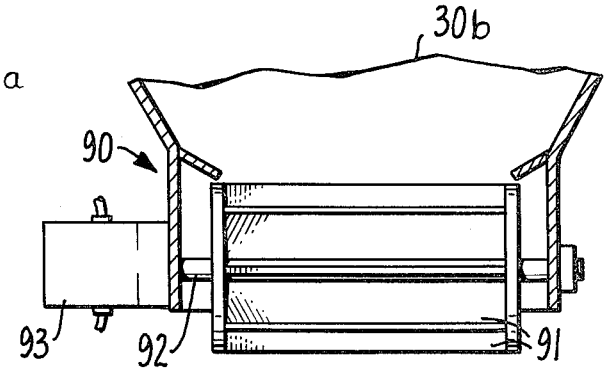
FIG. 6 is a sectional view along the line 6—6 of FIG. 5.

FIGS. 4 through 6 show an alternate discharge means 90 for auxiliary hopper 30. A positive displacement paddle wheel 91 is mounted transversely at the lowermost portion of auxiliary hopper **30*a* on a shaft 92 driven by hydraulic motor 93 connected to cab-mounted control lever 94. As the paddle wheel 91 is driven in the direction of the arrow 95, shown in FIG. 5, salt 17 is positively displaced from auxiliary hopper 30*a* and is discharged downwardly onto conveyor 20**.

Figure 7:
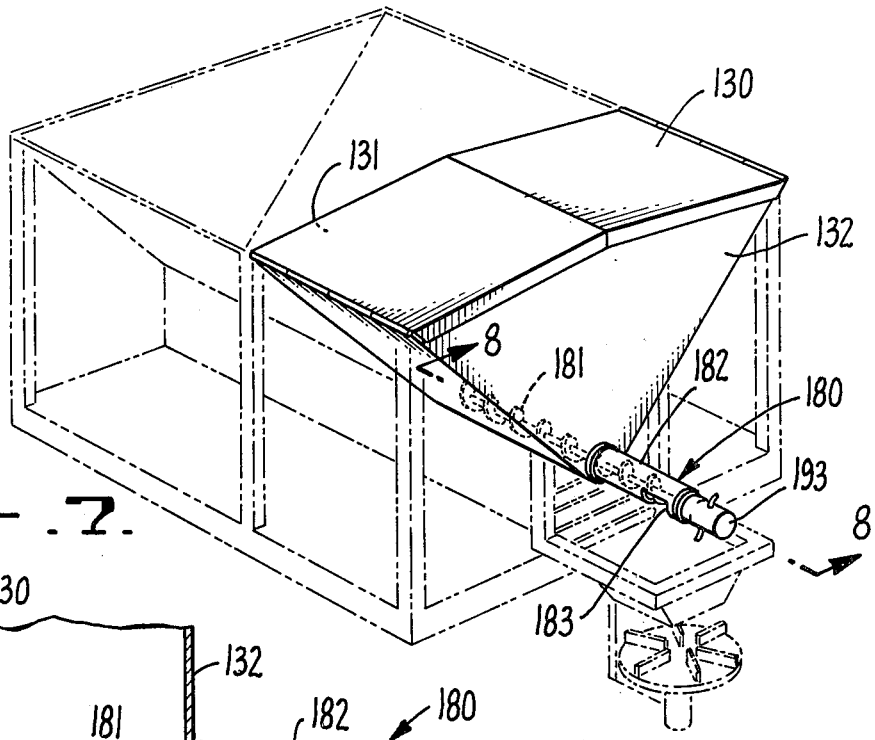
FIG. 7 is a perspective view of an alternate embodiment of the invention.
Figure 8:
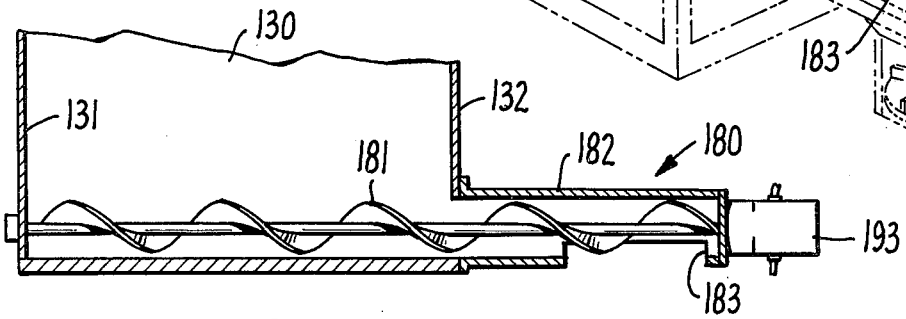
FIG. 8 is a sectional view along the line 8—8 of FIG. 7.

FIGS. 7 and 8 show an alternate form of the invention in which an alternate discharge means 180 is used for removing the contents of auxiliary hopper 130. In this embodiment, the lower portion of auxiliary hopper 130 is of different design than that shown in FIGS. 1–6. As shown in FIG. 7, the front and rear walls 131 and 132 respectively are vertical and are triangular in shape. Discharge means 180 comprises an auger 181 driven by hydraulic motor 193 in a similar fashion to hydraulic motor 93 shown in FIG. 4. Auger sleeve 182 extends beyond the rear wall 132 of auxiliary hopper 130 and has a recess 183 formed at the rearmost portion of sleeve 182 to allow the salt of drop directly onto discharge conveyor 20.

Figure 9:
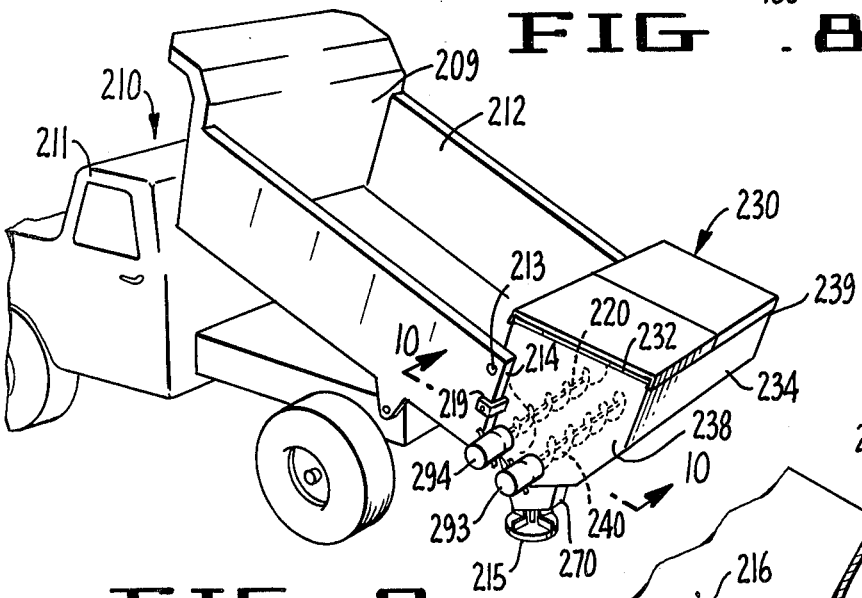
FIG. 9 is a perspective view of a dump truck incorporating an alternate embodiment of the invention.
Figure 10:
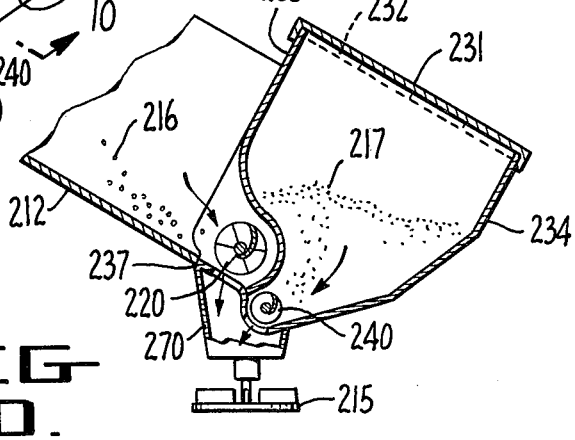
FIG. 10 is a sectional view along the line 10—10 of FIG. 9.

FIGS. 9 and 10 show an alternate form of the invention as applied to a conventional dump truck 210 having a cab 211 and a bed 212. Auxiliary storage means or auxiliary hopper 230 is attached to the rear of bed 212 by pins 213 which are carried on the upper half of bed 212 near rear wall 214. The bottom edge 237 of auxiliary hopper 230 is held against bed 212 by latch mechanism 219 normally used to secure a conventional tailgate. The contents of bed 212 may be emptied directly by opening latch mechanism 219, and as bed 212 is raised, auxiliary hopper 230 rotates with respect to pins 213, allowing cinders 216 to fall to the ground between the rear edge of bed 212 and the bottom edge 237 of auxiliary hopper 230. Auxiliary hopper 230 has a weather-proof lid 231 hinged at pins 232 and with front and rear walls 233 and 234 which converge at their lowermost extremes around discharge auger 240. Discharge auger 240 is driven by hydraulic motor 293 which is part of a hydraulic control circuit similar to that shown in FIG. 3. Bed 212 is emptied by discharge auger 220. Discharge auger 220 is driven by hydraulic motor 294 and operates as the front 209 of bed 212 is raised. Cinders 216 are then driven by auger 220 to the rear, driver side corner of bed 212 and are dropped into mixing chamber 270. By varying the speeds of augers 220 and 240, the operator can continuously vary the proportions of salt 217 and cinders 216 entering mixing chamber 270. The mixture drops onto the spreader 215 for application to the roadway.

Auger 220 is carried by the side walls 238 and 239 of auxiliary hopper 230. When latch mechanism 219 is released, auger 220 rotates with auxiliary hopper 230. Spinner 215 is hingedly suspended from the lower wall of auxiliary hopper 230 and thereby remains horizontal irrespective of the position of bed 212 or auxiliary hopper 230.

We claim:

1. In a vehicle for applying materials to icy or snow-covered roadways, having a storage tank carrying a first material and a spreader for applying said first material to the roadway, the improvement comprising:

auxiliary storage means mounted behind said storage tank for carrying a second material to be applied to the roadway, first discharge means for removing said materials from said storage tank, second discharge means for removing said second material from said auxiliary storage means, mixing means for mixing said materials, said second discharge means being positioned to discharge said second material on said first discharge means upstream of said mixing means, and control means for regulating the proportions of said first and second materials discharged from said storage tank and from said auxiliary storage means prior to said materials being applied to the roadway by said spreader.

2. The apparatus of claim 1 in which said control means includes a cab-mounted control mechanism for continuously adjusting the proportions of said first and second materials to be applied to the roadway.

3. The apparatus of claim 1 in which the discharge means of said auxiliary storage means comprises a slidable plate extending across the bottom of said auxiliary storage means and said control means comprises a cab-mounted control mechanism and a hydraulic drive mechanism for moving said slidable plate to various positions in response to the position of said control mechanism, whereby the proportions of said materials applied to the roadway may be continuously carried.

4. The apparatus of claim 1 in which the discharge means of said auxiliary storage means comprises:

a first slidable plate extending across the bottom of said auxiliary storage means, a hand crank connected to said first slidable plate for moving said plate from a closed position in which the bottom of said auxiliary storage means is closed off to an open position in which said first slidable plate does not obstruct the bottom of said auxiliary storage means, and a second slidable plate parallel with said first slidable plate, and in which said control means comprises a control mechanism and a hydraulic drive mechanism for moving said second slidable plate across the bottom of said auxiliary storage means in response to the position of said control mechanism, whereby the proportions of said materials applied to the roadway may be continuously varied.

5. In a dumptruck for applying materials to icy or snow-covered roadways, having a bed carrying a first material and a spreader for applying said first material to the roadway, the improvement comprising:

an auxiliary hopper attached to the rear of the bed of said truck for carrying a second material to be applied to the roadway, a discharge auger mounted transversely across the rear of said bed for removing said first material from said bed, a discharge auger for said auxiliary hopper mounted transversely across the bottom of said hopper, a mixing chamber into which both of said augers empty said first and second materials, and control means for regulating the proportions of said first and second materials discharged from said storage bed and from said auxiliary storage means prior to said materials being applied to the roadway by said spreader.

6. The apparatus of claim 5 in which said auxiliary hopper is pivotally connected to the upper half of the bed of said truck, so that as the front of said bed is raised, said auxiliary hopper swings away from said bed, allowing said bed to be emptied.

* * * * *